United States Patent [19]

Barrington

[11] 4,378,850

[45] Apr. 5, 1983

[54] HYDRAULIC FLUID SUPPLY APPARATUS AND METHOD FOR A DOWNHOLE TOOL

[75] Inventor: Burchus Q. Barrington, Duncan, Okla.

[73] Assignee: Halliburton Company, Duncan, Okla.

[21] Appl. No.: 159,304

[22] Filed: Jun. 13, 1980

[51] Int. Cl.[3] ..... E21B 34/64

[52] U.S. Cl. ..... 166/373; 166/321; 166/250; 166/336; 175/93

[58] Field of Search ..... 166/321, 322, 323, 324, 166/72, 373, 250, 336; 101/139; 251/57; 60/417; 175/93

[56] References Cited

U.S. PATENT DOCUMENTS

| | | | |
|---|---|---|---|
| Re. 27,464 | 8/1972 | Taylor, Jr. . | |
| 469,283 | 2/1892 | Straus . | |
| 2,178,931 | 11/1939 | Crites et al. . | |
| 3,170,137 | 2/1965 | Brandt | 340/18 |
| 3,381,766 | 5/1968 | Bannister | 166/65 R |
| 3,518,608 | 6/1970 | Papadopoulos | 339/16 |
| 3,568,715 | 3/1971 | Taylor, Jr. | 137/613 |
| 3,696,332 | 10/1972 | Dickson, Jr. et al. | 340/853 |
| 3,860,742 | 1/1975 | Medney | 174/845 |
| 3,879,097 | 4/1975 | Oertle | 339/16 R |
| 3,955,623 | 4/1976 | Aumann | 251/63.4 |
| 3,961,308 | 5/1976 | Parker | 367/82 |
| 3,964,544 | 6/1976 | Farley et al. | 166/321 |
| 3,967,647 | 7/1976 | Young | 137/614.11 |
| 4,009,753 | 3/1977 | McGill et al. | 166/55.1 |
| 4,065,747 | 12/1977 | Patten et al. | 340/16 C |
| 4,073,341 | 2/1978 | Parker | 166/72 |
| 4,116,272 | 9/1978 | Barrington | 166/72 |
| 4,147,222 | 3/1979 | Patten et al. | 175/9 |
| 4,211,291 | 7/1980 | Kellner | 175/93 |

OTHER PUBLICATIONS

The Oil & Gas Journal, 7/3/78, System Uses Internal Copper, p. 72–76.

Otis Engineering Corp., Catalog OEC-5134c, pp. 1 and 10–15.

Flopetrol Div. of Schlumberger Brochure entitled Deep Water Operation System.

Composite Catalog of Oil Field Equipment & Services, (34th Ed., 1980–1981), Published by *World Oil*, pp. 1484–1485.

Composite Catalog of Oil Field Equipment & Services, (1978–1979), Published by World Oil, p. 6725.

*Primary Examiner*—William F. Pate, III

*Attorney, Agent, or Firm*—Lucian Wayne Beavers; Joseph A. Walkowski; Thomas R. Weaver

[57] ABSTRACT

A hydraulic fluid supply apparatus for a downhole tool includes a first annular zone adapted to be filled with hydraulic oil and a second annular zone adapted to be filled with a pressurized second fluid. The first and second zones are separated by a floating annular piston for transmitting fluid pressure from the second zone to the first zone. A control valve is connected between the first zone and a hydraulically powered component of the downhole tool for directing hydraulic fluid under pressure from the first zone to the hydraulically powered component of the downhole tool.

17 Claims, 17 Drawing Figures

HYDRAULIC FLUID SUPPLY APPARATUS AND METHOD FOR A DOWNHOLE TOOL

The present invention relates to a hydraulic fluid supply system for a downhole tool, and more particularly, but not by way of limitation, to such a system included as part of a subsea test tree for controlling the flow of fluids through a testing string located in an offshore oil well during a production test or the like.

During the drilling or testing of offshore wells it is desirable to include in the pipe string a control valve which is positioned in the vicinity of a blowout preventor stack. This blowout preventor stack normally rests on the sea floor with the control valve located in the stack for controlling oil well fluids flowing through the testing or drill string.

These subsea test tree control valves are preferably operated using hydraulic pressure to actuate tandem valves for opening and closing the flow path through the valve apparatus. It has been the practice in the past to include hydraulic lines lowered from the surface of the sea to supply operating hydraulic fluid to control the tandem valves. For instance, such control valves have been disclosed in U.S. Reissue Pat. No. Re. 27,464 to Taylor and U.S. Pat. No. 3,967,647 to Young. These control devices may include separate hydraulic fluid control lines or concentric tubing strings extending from the control device to the surface.

Another subsea test tree which utilizes a hydraulic control line, which is already in place relative to the blowout preventor stack, is shown in U.S. Pat. No. 4,116,272 to Barrington and assigned to the assignee of the present invention.

With any of these prior art systems utilizing hydraulic lines connecting the blowout preventor stack or the subsea test tree itself with a hydraulic supply source at the surface of the body of water within which the well is located, numerous problems are present which are primarily attributable to the hydraulic lines.

Hydraulic lines which are exposed on the outside of the drill pipe are frequently cut either at the rotary table at the surface or down inside the riser pipe. This is due to the rubbing, pinching or twisting movement created between the outside diameter of the drill pipe and the inside diameter of the riser pipe, which motion is due in part to wave action on large bodies of water.

Also, during the testing procedure when it is desired to set a packer on the well test string, it is often required to rotate the drill pipe to manipulate and actuate the packer. Rotation of the drill pipe with large amounts of hydraulic hose attached thereto causes significant operational problems, particularly at the surface location where the hydraulic hose is attached to the drill pipe.

Additionally, when operating in very deep water, the hydrostatic head of hydraulic oil in the hydraulic line may sometimes be sufficient to activate the ball valves due merely to the hydrostatic head of oil contained within the lines. To overcome these problems, it is sometimes necessary to replace the hydraulic oil with compressed air or nitrogen, and either of those gases are more prone to leakage than oil, thereby causing even further problems.

The acoustic subsea test tree of the present invention eliminates all of these problems related to hydraulic lines connecting the test tree to the surface, by eliminating the hydraulic lines to the test tree. A self contained pressure source is provided in a subsea test tree housing and is lowered into the well along with the remainder of the subsea tree. The subsea test tree also includes apparatus for receiving acoustic signals transmitted from the surface, and thereby controlling flow of fluid from the pressure source to operate the ball valves of the test tree.

The hydraulic fluid supply apparatus includes a first annular zone adapted to be filled with hydraulic oil and a second annular zone adapted to be filled with a pressurized second fluid. The first and second zones are separated by a floating annular piston for transmitting fluid pressure from the second zone to the first zone. A control valve is connected between the first zone and the hydraulically powered closure valve of the subsea test tree for directing hydraulic fluid under pressure from the first zone to the closure valve.

Numerous objects, features and advantages of the present invention will be readily apparent to those skilled in the art upon a reading of the following disclosure when taken in conjunction with the accompanying drawings.

FIGS. 3A–3I comprise a schematic elevation cross section view of the subsea test tree of the present invention.

Figure 2:
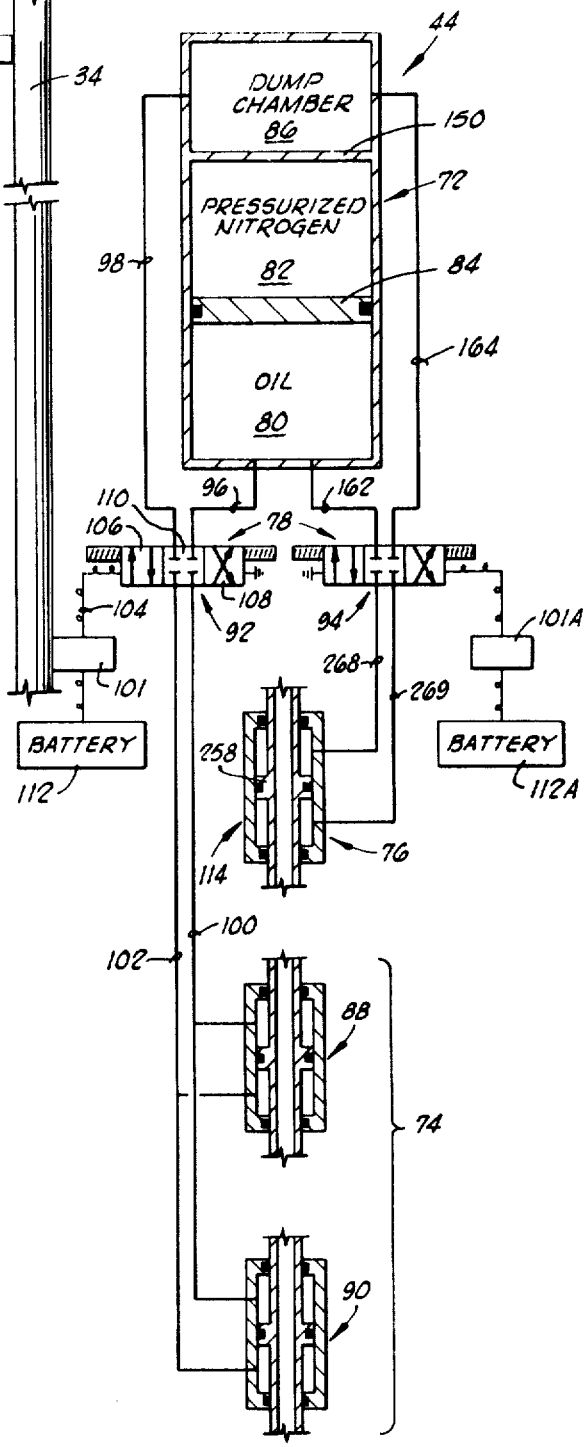
FIG. 2 is a schematic view of the acoustic transmitting and receiving apparatus and the hydraulic system connected thereto for directing hydraulic fluid to the components to be actuated thereby.
Figure 4:
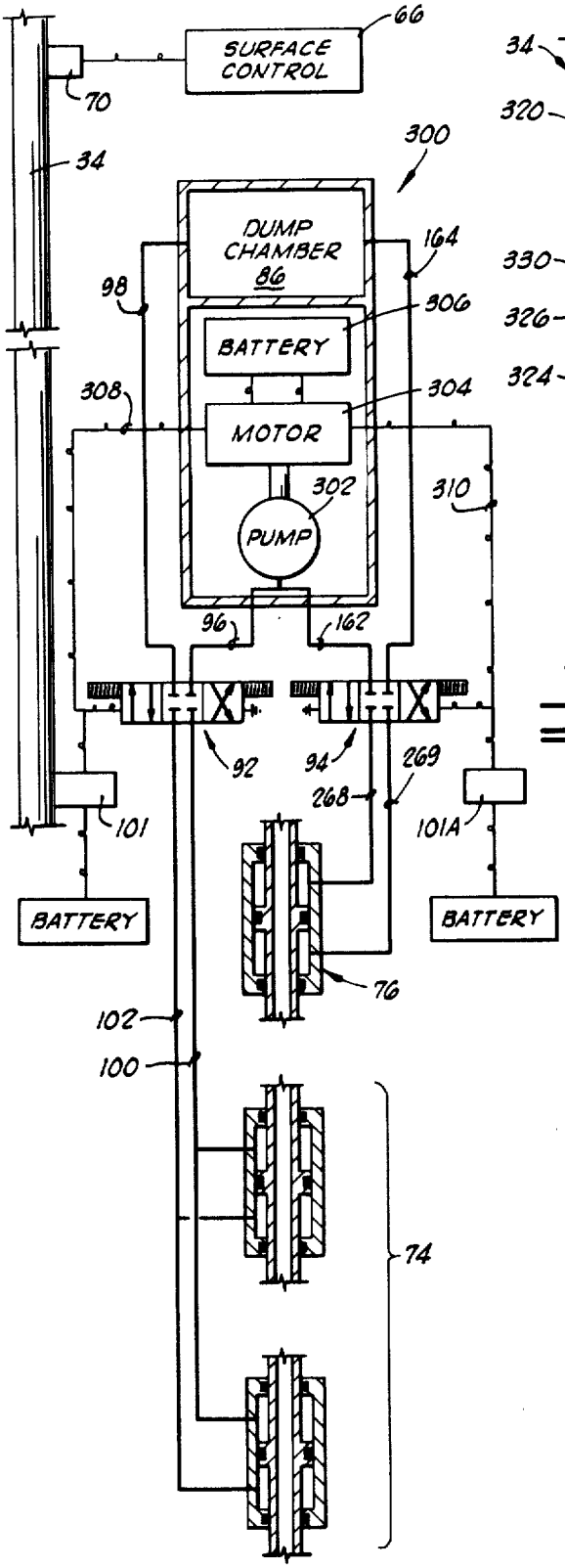
Figure 3:
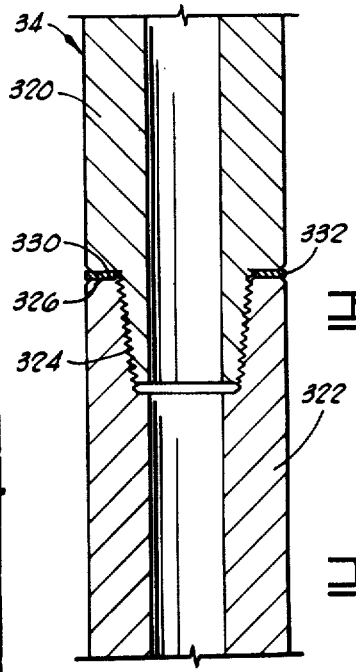

FIG. 4 is a schematic illustration similar to FIG. 2 showing an alternative embodiment of the present invention wherein the hydraulic fluid supply is provided by an electrically powered pump disposed within the subsea test tree housing.

Figure 5:
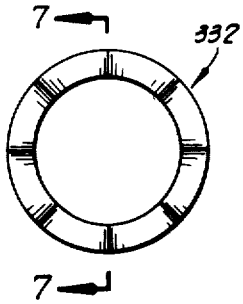

FIG. 5 is an elevation section view of two pipe segments connected together by an acoustic coupling means of the present invention.

Figure 6:
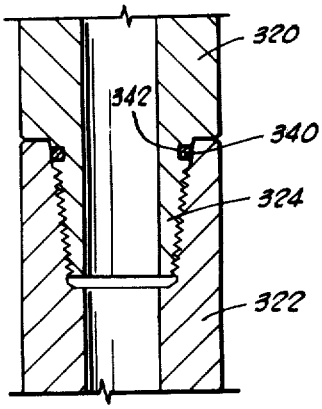

FIG. 6 is a plan view of the acoustic coupling means utilized in FIG. 5.

Figure 7:
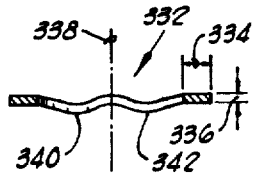

FIG. 7 is a sectional view taken along lines 7—7 of FIG. 6.

Figure 8:
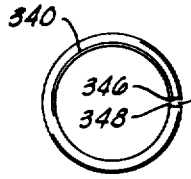

FIG. 8 is a sectional elevation view of two pipe segments utilizing an alternative form of acoustic coupling means.

It is appropriate at this point to provide a description of the environment in which the present invention is used. During the course of drilling an oil well, the borehole is filled with a fluid known as drilling fluid or drilling mud. One of the purposes of this drilling fluid is to contain in intersected formations any formation fluid which may be found there. To contain these formation fluids the drilling mud is weighted with various additives so that the hydrostatic pressure of the mud at the formation depth is sufficient to maintain the formation fluid within the formation without allowing it to escape into the borehole.

When it is desired to test the production capabilities of the formation, a testing string is lowered into the borehole to the formation depth and the formation fluid is allowed to flow into the string in a controlled testing program.

Sometimes, lower pressure is maintained in the interior of the testing string as it is lowered into the borehole. This is usually done by keeping a formation tester valve in the closed position near the lower end of the testing string. When the testing depth is reached, a packer is set to seal the borehole thus closing the formation from the hydrostatic pressure of the drilling fluid in the well annulus. The formation tester valve at the lower end of the testing string is then opened and the formation fluid, free from the restraining pressure of the drilling fluid, can flow into the interior of the testing string.

At other times the conditions are such that it is desirable to fill the testing string above the formation tester valve with liquid as the testing string is lowered into the well. This may be for the purpose of equalizing the hydrostatic pressure head across the walls of the test string to prevent inward collapse of the pipe and/or may be for the purpose of permitting pressure testing of the test string as it is lowered into the well.

The well testing program includes periods of formation flow and periods when the formation is closed in. Pressure recordings are taken throughout the program for later analysis to determine the production capability of the formation. If desired, a sample of the formation fluid may be caught in a suitable sample chamber.

At the end of the well testing program, a circulation valve in the test string is opened, formation fluid in the testing string is circulated out, the packer is released, and the testing string is withdrawn.

Figure 1:
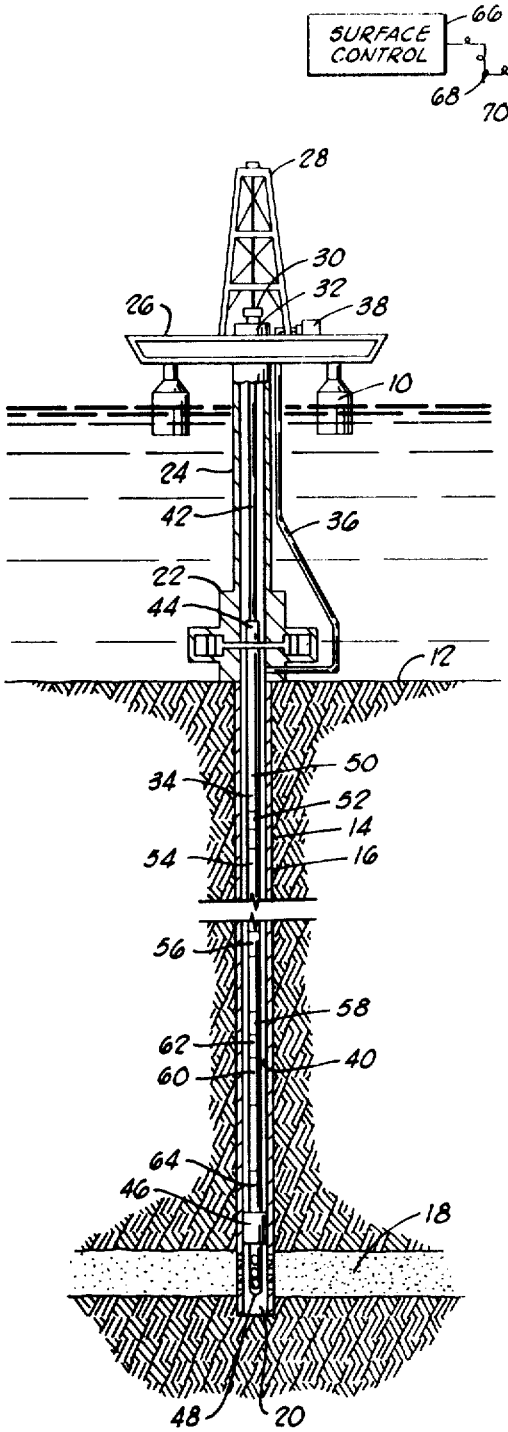
FIG. 1 shows an overall cross-sectional view of a typical well testing installation where the apparatus of the present invention may be used.

A typical arrangement for conducting a drill stem test offshore is shown in FIG. 1. Such an arrangement would include a floating work station 10 stationed over a submerged work site 12. The well comprises a well bore 14 typically lined with a casing string 16 extending from the work site 12 to a submerged formation 18. The casing string 16 includes a plurality of perforations at its lower end which provide communication between the formation 18 and the interior of the well bore 20.

At the submerged well site 12 is located the well head installation 22 which includes blowout preventor mechanisms. A marine conductor 24 extends from the well head installation to the floating work station 10. The floating work station 10 includes a work deck 26 which supports a derrick 28. The derrick 28 supports a hoisting means 30. A well head closure 32 is provided at the upper end of marine conductor 24. The well head closure 32 allows for lowering into the marine conductor and into the well bore 14 a formation testing string 34 which is raised and lowered in the well by hoisting means 30.

A supply conduit 36 is provided which extends from a hydraulic pump 38 on the deck 26 of the floating station 10 and extends to the well head installation 22 at a point below the blowout preventor to allow the pressurizing of the well annulus 40 surrounding the test string 34.

The testing string 34 includes an upper conduit string portion 42 extending from the work site 12 to the well head installation 22. A subsea test tree 44 of the present invention is located at the end of the upper conduit string 42 and is landed in the well headed installation 22 to thus support the lower portion of the formation testing string, as is described in more detail below. The lower portion of the formation testing string extends from the test tree 44 to the formation 18. A packer mechanism 46 isolates the formation 18 from fluids in the well annulus 40. A perforated tail piece 48 is provided at the lower end of the testing string 34 to allow fluid communication between the formation 18 and the interior of the tubular formation testing string 34.

The lower portion of the formation testing string 34 further includes intermediate conduit portion 50 and torque transmitting pressure and volume balanced slip joint means 52. An intermediate conduit portion 54 is provided for imparting packer setting weight to the packer mechanism 46 at the lower end of the string.

It is many times desirable to place near the lower end of the testing string a conventional circulation valve 56 which may be opened by rotation or reciprocation of the testing string or a combination of both or by the dropping of a weighted bar in the interior of the testing string 10. Below circulating valve 56 there may be located a combination sampler valve section and reverse circulation valve 58.

Also near the lower end of the formation testing string 34 is located a formation tester valve 60 which is preferably a tester valve of the annulus pressure operated type. Immediately above the formation tester valve 60 there may be located a drill pipe tester valve 62.

A pressure recording device 64 is located below the formation tester valve 60. The pressure recording device 64 is preferably one which provides a full opening passageway through the center of the pressure recorder to provide a full opening passageway through the entire length of the formation testing string.

It may be desirable to add additional formation testing apparatus in the testing string 34. For instance, where it is feared that the testing spring 34 may become stuck in the borehole 14 it is desirable to add a jar mechanism between the pressure recorder 64 and the packer assembly 46. The jar mechanism is used to impart blows to the testing string to assist in jarring a stuck testing string loose from the borehole in the event that the testing string should become stuck. Additionally, it may be desirable to add a safety joint between the jar and the packer mechanism 46. Such a safety joint would allow for the testing string 34 to be disconnected from the packer assembly 46 in the event that the jarring mechanism was unable to free a stuck formation testing string.

The location of the pressure recording device may be varied as desired. For instance, the pressure recorder may be located below the perforated tail piece 48 in a suitable pressure recorder anchor shoe running case. In addition, a second pressure recorder may be run immediately above the formation tester valve 60 to provide further data to assist in evaluating the well.

Referring now to FIG. 2, the acoustic subsea test tree 44 of the present invention, which may generally be referred to as a downhole tool, is there schematically illustrated.

At the upper left portion of FIG. 2 the well test string 34 is shown in a schematic form. Located upon the work deck 26 of FIG. 1, is a surface control station 66 which is connected by electrical connecting means 68 to an acoustic transmittor 70 which is acoustically coupled to the well test string 34 for transmitting an acoustic signal down the well test string 34.

As is best shown in FIG. 1, the subsea test tree 44 is located at an intermediate point within the test string 34. The remainder of FIG. 2 schematically illustrates the internal components of the subsea test tree 44 and it will be understood that those components are disposed within the well test string 34.

The subsea test tree 44 generally includes a hydraulic fluid power supply section 72, a tandem ball closure valve section 74, a combination latch and hydraulic connector section 76, and a control valve section 78 for directing hydraulic fluid under pressure from the source 72 to the closure valve section 74 and the latch and hydraulic connection section 76.

The hydraulic fluid supply section 72 includes a first zone 80 adapted to be filled with a hydraulic fluid such as oil and a second zone 82 adapted to be filled with a pressurized section fluid such as nitrogen gas.

A floating piston means 84 separates first and second zones 80 and 82 for transmitting pressure from fluid in one of said zones to fluid in the other of said zones. An empty dump chamber 86 is provided for receiving spent hydraulic fluid.

The closure valve section 74 includes first and second hydraulic cylinder portions 88 and 90 for operating first and second ball valve means for closing a flow passage through the well test string 34.

A first electrically operated three position solenoid valve 92 of control valve means 78 controls flow of hydraulic fluid to and from the closure valve section 74. A second electrically powered three position solenoid valve 94 controls flow of hydraulic fluid to and form a hydraulically powered latching means of latch and hydraulic connector section 76. This latching means generally provides a means for rapidly connecting and disconnecting a portion of the well test string 34 above the closure valve section 74 to a portion of the test tree 44 containing closure valve section 74, so that in the event of bad weather or the like, closure valve section 74 may be closed and left in place within the well head installation 22 while that portion of the test string 34 located above the well head installation 22 may be disconnected and retrieved.

A fluid passage 96 connects the oil supply zone 80 of fluid supply section 72 with the first solenoid valve 92. A second passage 98 connects first solenoid valve 92 with the dump chamber 86. A first closure valve power conduit means 100 connects solenoid valve 92 in a hydraulically parallel fashion to the top sides of each of the hydraulic cylinders 88 and 90. Similarly, a second closure valve power conduit 102 connects first solenoid valve 92 in a hydraulically parallel fashion to the lower ends of each of the hydraulic cylinders 88 and 90.

The subsea test tree 44 includes a signal receiving means 101 which is acoustically coupled to the well test string 34 for receiving an acoustic signal transmitted down the well test string 34. The signal receiving means 101 includes means for decoding the acoustic signal received and converting it to an electrical signal to be transmitted over electrical connecting means 104 to the first solenoid valve 92, so as to cause the first solenoid valve 92 to be moved to one of three positions.

In a first position represented by the left hand block 106 of the schematically illustrated solenoid valve 92, the conduit 96 is communicated with the conduit 100 and the conduit 102 is communicated with the conduit 108, so that hydraulic fluid under pressure is transmitted from the oil supply 80 to the top ends of hydraulic cylinders 88 and 90 to close the valve members of closure valve section 74. Low pressure hydraulic fluid from the lower ends of hydraulic cylinders 88 and 90 is returned to dump chamber 86.

In a second position of first solenoid valve 82 represented by the right hand block 108 of the schematically illustrated valve 92, the conduit 96 is communicated with the conduit 102 and the conduit 100 is communicated with the conduit 98 so that hydraulic fluid under pressure is supplied to the lower ends of cylinders 88 and 90 thereby opening the closure valve means of closure valve section 74. Spent hydraulic fluid from the upper ends of cylinders 88 and 90 is returned to the dump chamber 86 through conduits 100 and 98.

When no power is being supplied to the solenoid valve 92, the solenoid valve 92 is spring centered in a third position illustrated by the third block 110 wherein no hydraulic fluid is allowed to flow to or from the hydraulic cylinders 88 and 90 and those cylinders are thereby hydraulically locked in place.

Power to acoustic receiving means 101 and first solenoid means 92 is provided by battery means 112.

When it is desired to actuate the hydraulically powered latching means of latch and hydraulic connector section 76, an acoustic signal transmitted from acoustic transmitter 70 is picked up by a second portion 101A of signal receiving means 101 which second portion 101A directs second electrically powered solenoid valve 94 to supply hydraulic fluid to an upper or lower end of the hydraulic cylinder 114 of the latching means to cause the latch means to be hydraulically latched or unlatched.

Referring now to FIGS. 3A–3I, the construction of the subsea test tree 44 is thereshown in much greater detail. It is noted, however, that FIGS. 3A–3I are partially schematic.

The subsea test tree 44 includes a subsea test tree body generally designated by the numeral 116, which includes a longitudinal bore or flow passage 118 therethrough.

Figure 3A:
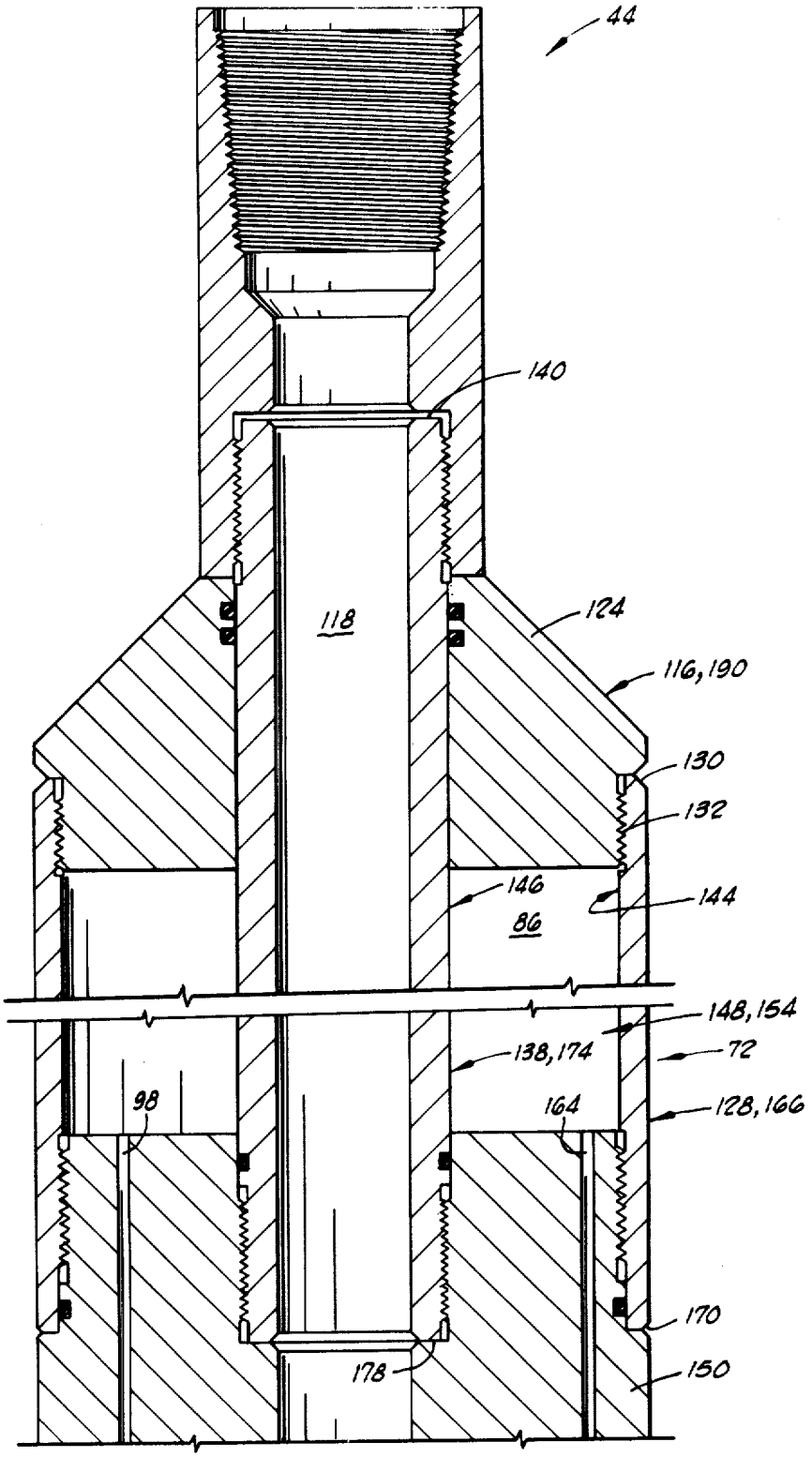
Figure 3B:
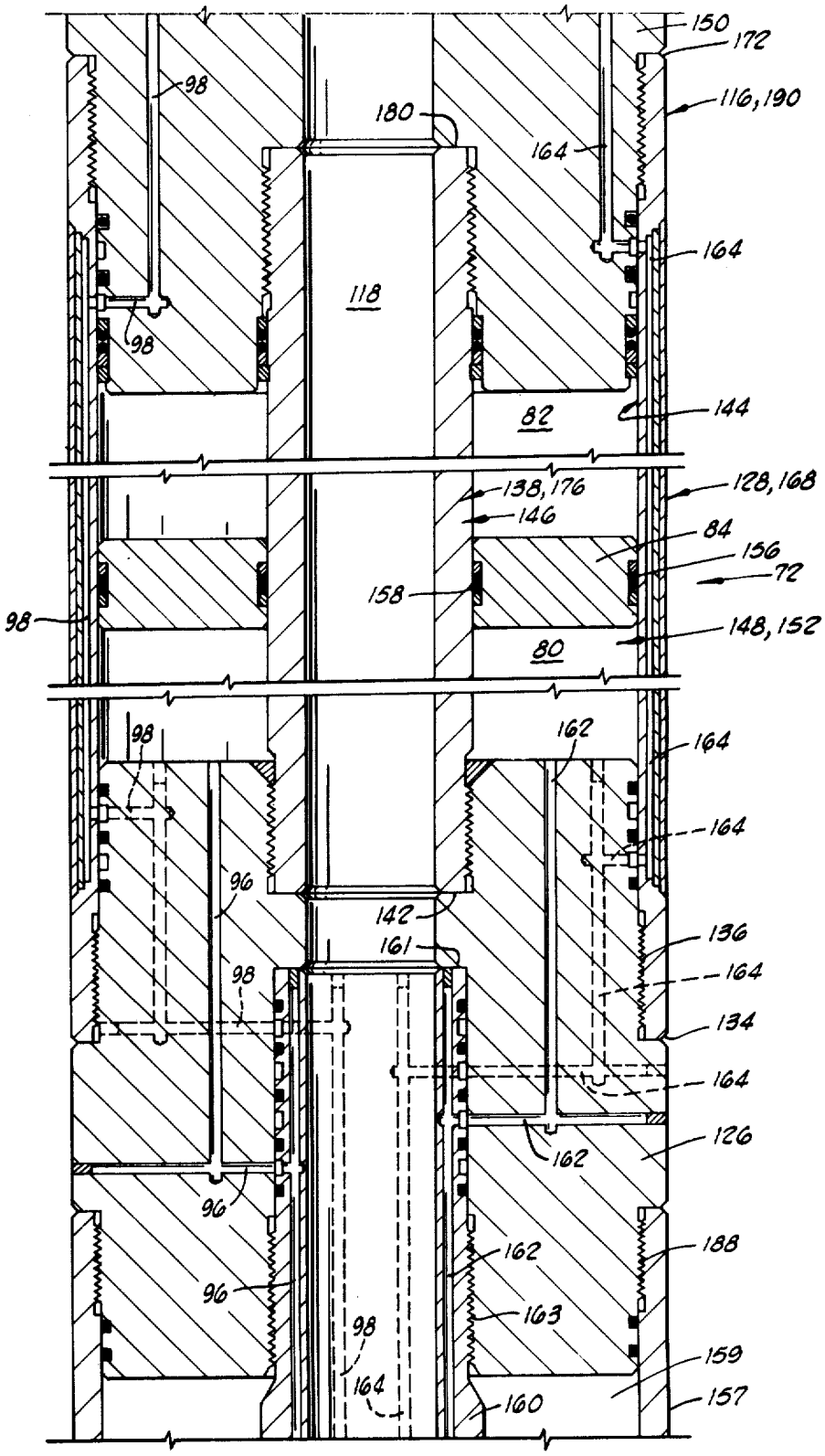
Figure 3C:
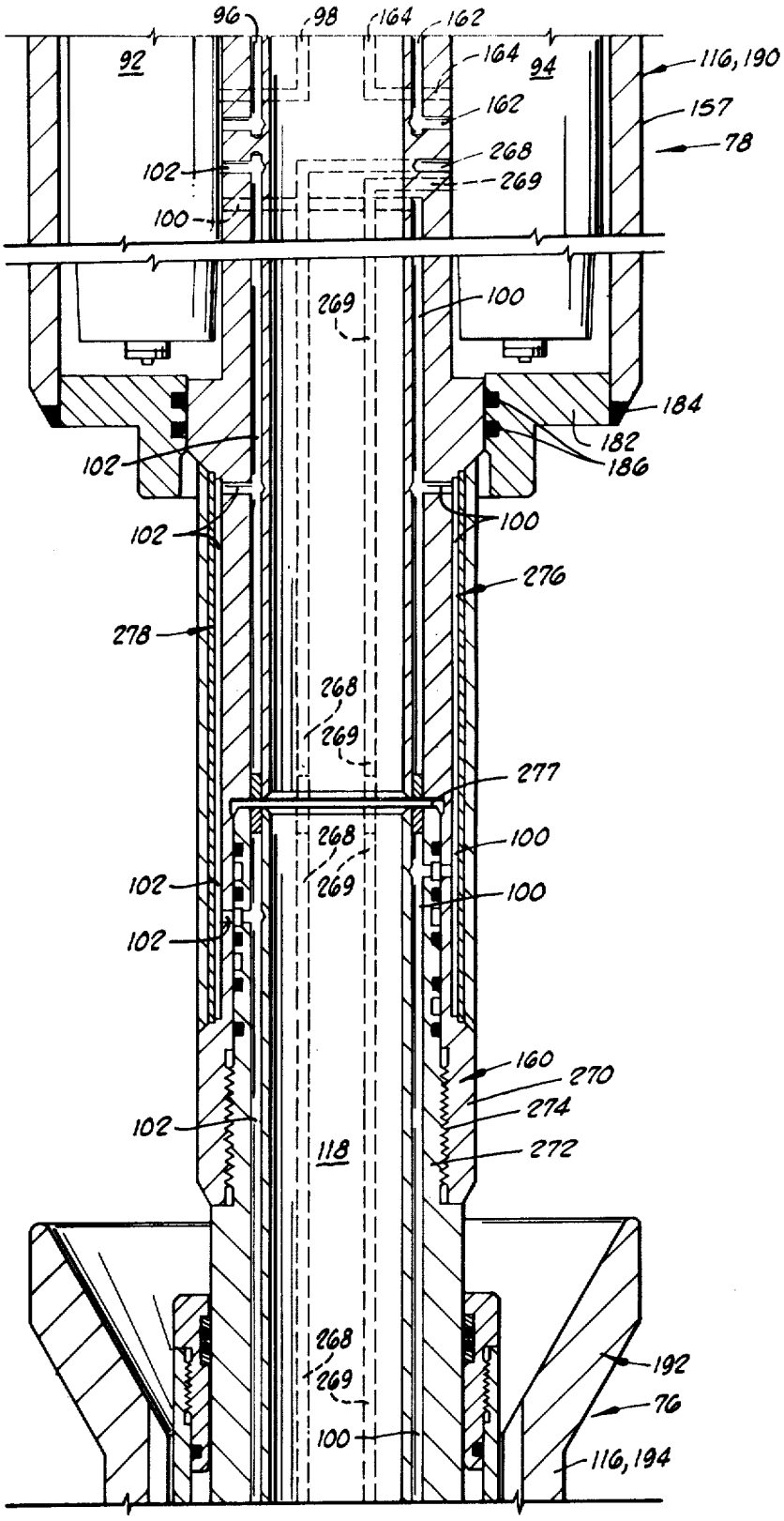
Figure 3D:
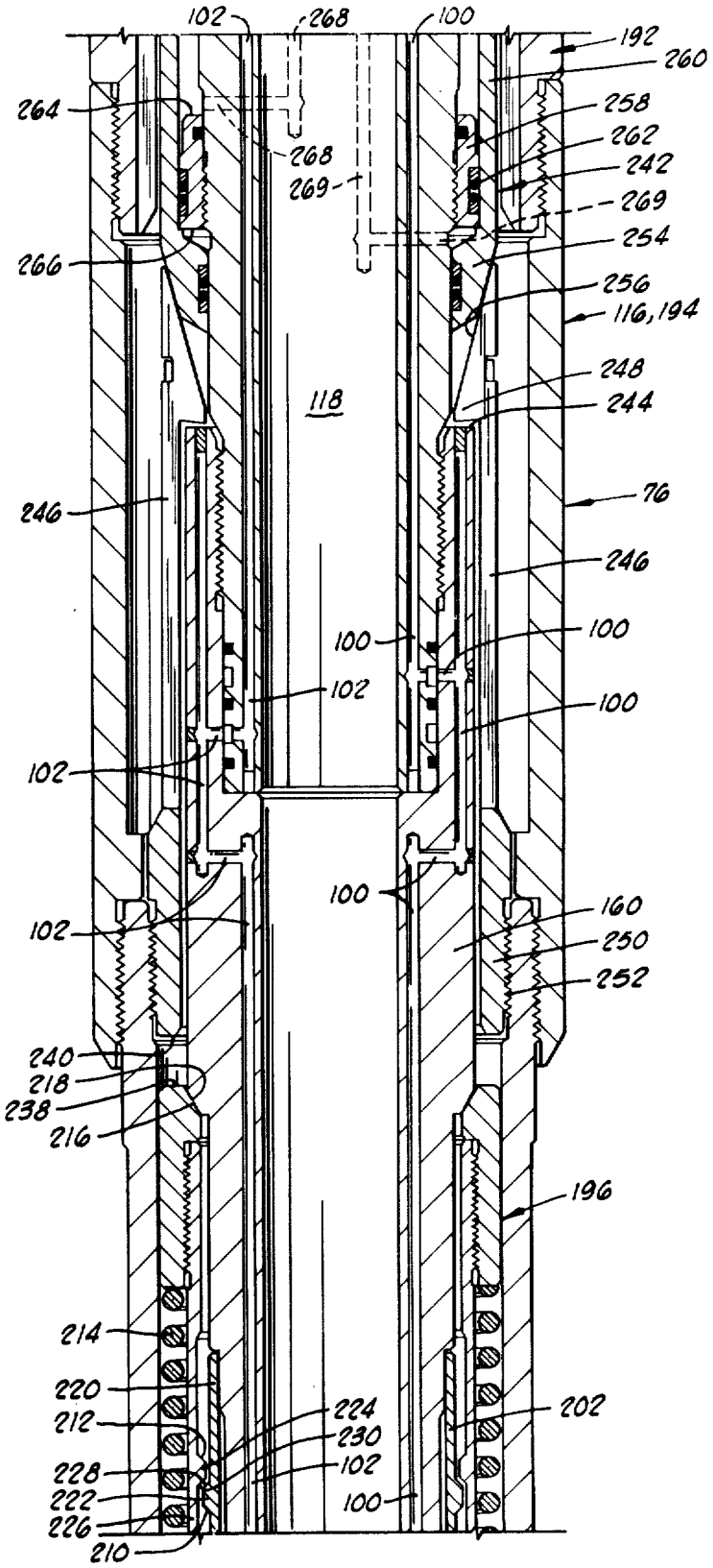
Figure 3E:
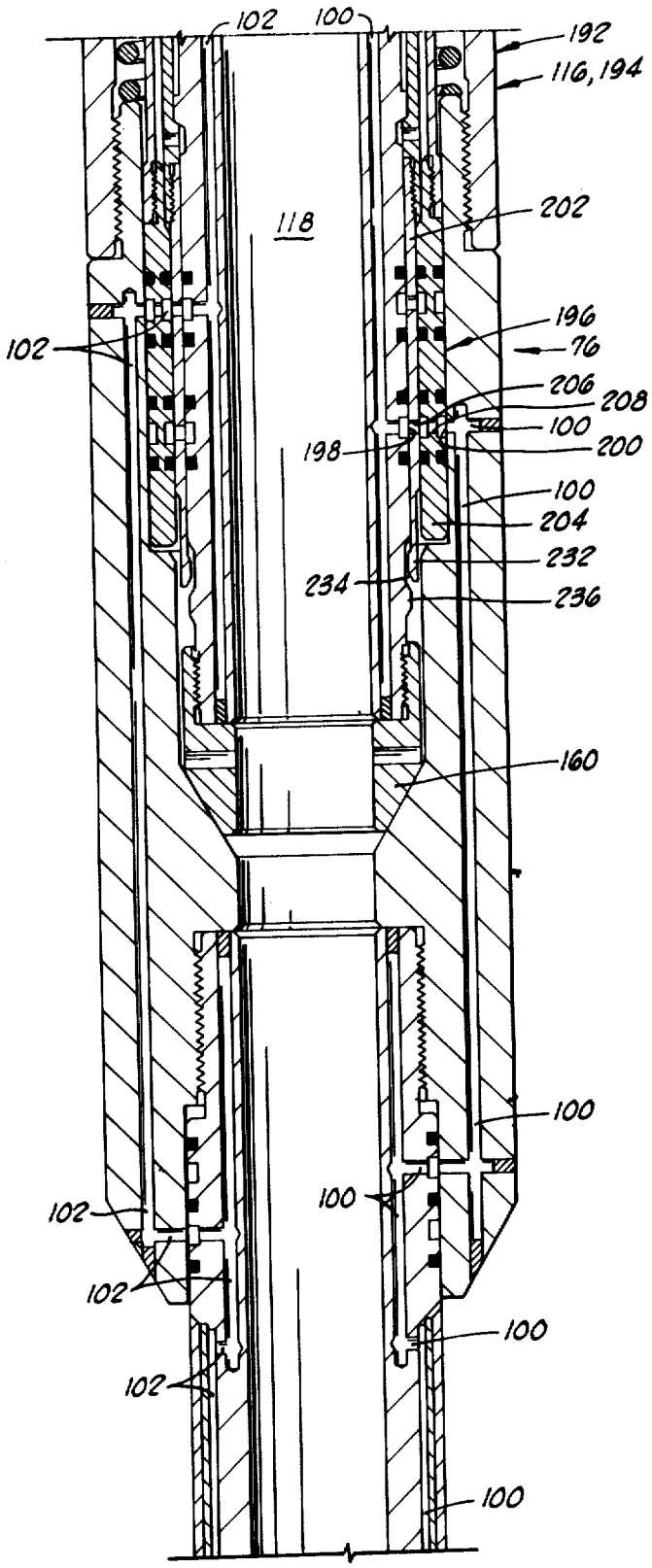

The hydraulic fluid supply section 72 is generally shown in FIGS. 3A and 3B. The closure valve section 74 is generally shown in FIGS. 3F–3I. The latch and hydraulic connector section 76 is generally shown in FIGS. 3D and 3E. The control valve section 78 is generally shown in FIG. 3C.

The hydraulic fluid supply section 72 in combination with the closure valve section 74 which includes first and second ball valves 120 and 122 powered by first and second hydraulic cylinders 88 and 90, respectively, may be collectively referred to as an actuator means operably associated with the signal receiving means 101 for actuating the closure valve section 78 to move the ball valves 120 and 122 to a desired one of their open and closed positions in response to the acoustic command signal received by signal receiving means 101.

Referring again to the hydraulic fluid supply section 72 shown in FIGS. 3A and 3B, that hydraulic fluid supply section 72 includes an upper adapter 124, a lower adapter 126, and an outer cylindrical tubular casing means, generally designated by the numeral 128, having an upper end 130 attached to upper adapter 124 at threaded connection 132 and having a lower end 134 attached to lower adapter 126 at threaded connection 136.

An inner cylindrical tubular mandrel means generally designated by the numeral 138 is concentrically disposed within casing means 128 and has its upper and lower ends 140 and 142 connected to said upper and lower adapters 124 and 126, respectively. Said upper and lower adapters 124 and 126, an inner cylindrical surface 114 of casing means 128, and an outer cylindrical surface 146 of mandrel means 138 define an annular cavity means 148 therebetween.

A fixed annular divider means 150 is connected between inner and outer cylindrical surfaces 144 and 146 for separating annular cavity means 148 into first and second annular cavity portions 152 and 154, respectively.

The floating piston 84 previously described with reference to FIG. 2 is shown in more detail in FIG. 3B and may generally be described as a movable annular divider means 84. Floating piston 84 includes seal means 156 and 158, for sealingly engaging inner and outer cylindrical surfaces 144 and 146 of casing 128 and mandrel means 138, respectively, for separating first annular cavity portion 152 into the first and second annular zones 80 and 82, respectively, which correspond to the hydraulic oil section and to the pressurized nitrogen sections 80 and 82 previously described with reference to FIG. 2.

The hydraulic fluid supply zone 80 is partially defined by the inner mandrel 138, the outer casing 128 and a lower side of the floating piston 84. The pressurized nitrogen zone 82 is partially defined by the outer casing 128, the inner mandrel 138 and the upper side of the floating piston means 84.

Second annular cavity portion 154 is the dump section 86, previously described with regard to FIG. 2.

Located below lower adapter 126 is a control valve housing 157. The components of the control valve section 78 are located within an annular space 159 between housing 157 and a stinger mandrel 160. An upper end 161 of stinger mandrel 160 is attached to lower adapter 126 at threaded connection 163.

The first and second solenoid valves 92 and 94 are shown on the left and right hand sides of upper portion of FIG. 3C within housing 157.

The passage 96 shown in FIG. 2 connecting hydraulic oil supply zone 80 with first control valve 92 is disposed in lower adapter 126 and the stinger mandrel 160 which is further described below.

The passage 98 for returning spent hydraulic fluid from first solenoid valve 92 to the dump chamber 96 is disposed in stinger mandrel 160, lower adapter 126, casing 128 and fixed annular divider 150.

Similarly, a supply passage 162 conducts hydraulic fluid from the hydraulic fluid supply 80 to the second solenoid valve 94, and a return passage 164 returns low pressure hydraulic fluid from second solenoid valve 94 to the dump chamber 86.

It will be understood that the passages 96, 98, 162 and 164 are somewhat schematically shown in FIGS. 3A-3C.

The casing means 128 includes an upper casing portion 166 and a lower casing portion 168. A lower end 170 of upper casing portion 166 is attached to fixed annular divider means 150, and an upper end 172 of lower casing portion 168 is also attached to fixed annular divider means 150.

Also, the inner mandrel means 138 includes an upper inner mandrel portion 174 and a lower inner mandrel portion 176. A lower end 178 of upper inner mandrel portion 174 is attached to fixed annular divider means 150 and an upper end 180 of lower inner mandrel portion 176 is also attached to fixed annular divider means 150.

The lower end of control valve housing 156 has an annular sliding shoe 182 attached thereto at weld 184. Sealing means 186 are disposed between an inner surface of shoe 182 and an outer surface of stinger mandrel 160. The components of control valve section 78 disposed in housing 157 are readily accessible by breaking the threaded connection 188 between control valve housing 157 and lower adapter 126 and then sliding the control valve housing 157 downward relative to stringer mandrel 160 thereby exposing the components located within housing 157 for easy access and servicing.

As was previously noted the first and second control valves 92 and 94 are located within the annular space 159 between control valve housing 157 and stinger mandrel 160 as shown in FIG. 3C. Also located within that annular space 159 is the battery means 112 and the acoustic signal receiving means 101 previously described with reference to FIG. 2. Those components are not shown in FIG. 3B or 3C.

The stinger mandrel 160 and the components located thereabove as shown in FIGS. 3A, 3B and 3C may generally be referred to as an upper portion 190 of the subsea test tree body 116.

The stinger mandrel 160 is received within a stinger receiving tube 192 illustrated in FIGS. 3C-3E. The stinger receiving tube 192 and those components of the subsea test tree body 116 located therebelow may generally be referred to as a lower body portion 194 of the subsea test tree body 116. The closure valve section 74 is disposed in the lower body portion 194.

The latch and hydraulic connector section 76 shown in FIGS. 3C-3E provides a means for connecting and disconnecting the upper and lower body portions 190 and 194 of subsea test tree body 116. This allows the hydraulic fluid supply section 72 to be released and retrieved to the work deck 26 of the floating work station 10 while the lower body portion 194 with the closure valve means 72 therein remains attached to the well head installation 22 located at the submerged worksite 12 on the floor of the ocean.

The latch and hydraulic connector section 76 includes both a hydraulic connecting device for connecting fluid passage means in the upper body portion 190 with fluid passage means in the lower body portion 194, and includes a mechanical latch for physically connecting the upper body portion and lower body portion 190 and 194 to hold them together.

The passage 100 previously described with regard to FIG. 2 which communicates the first solenoid valve 92 with the upper ends of hydraulic cylinders 88 and 90 is shown in FIGS. 3C-3I. Also shown in FIGS. 3C-3I is the passage 102 connecting the lower ends of hydraulic cylinders 88 and 90 with first solenoid valve 92.

The latch and hydraulic connector section 76 includes a hydraulic connector, generally designated by the numeral 196 in FIGS. 3D and 3E, which provides a means for connecting and disconnecting the portions of passageways 100 and 102 within upper body portion 190 with the portions of passageways 100 and 102 in lower body portion 194.

With regard to the hydraulic connector 196, and particularly described with reference to the portion of hydraulic passage 100 shown in FIG. 3E, the stinger mandrel 160 may generally be described as a first cylindrical tubular member having a first hydraulic portion 198 in a radially outer surface thereof.

The stinger receiving tube 192 may generally be described as a second cylindrical tubular member having a second hydraulic port 200 disposed in a radially inner surface thereof.

A first cylindrical sliding sleeve valve 202 is disposed about stinger mandrel 160 and movable relative to stinger mandrel 160 between open and closed positions wherein said first hydraulic port 198 in stinger mandrel 160 is opened and closed, respectively.

The first sleeve valve 202 is shown in FIG. 3E in its open position relative to stinger mandrel 160.

A second cylindrical sliding sleeve valve 204 is disposed within a radially inner surface of stinger receiving tube 192 and movable relative to stinger receiving tube 192 between open and closed positions wherein the second hydraulic port 200 is opened and closed, respectively. Sleeve valve 204 is shown in its open position in FIG. 3E.

An interconnecting means is provided for moving the first and second sliding sleeve valves 202 and 204 to their respective open positions, as shown in FIG. 3E, when stinger mandrel 160 is inserted within stinger receiving tube 192 by movement of the stinger mandrel 160 in a downward direction relative to the stinger receiving tube 192.

The first sleeve valve 202 has a first valve port 206 disposed therein for communication with first hydraulic port 198 when first sleeve valve 202 is in its said open position.

Second sleeve valve 204 has a second valve port 208 disposed therein for communication with second hydraulic port 200 of second sleeve valve 204 when second sleeve valve 204 is in its said open position.

The first and second sleeve valves 202 and 204 are so arranged and constructed that said first and second valve ports 206 and 208 are in communication with each other when said first and second sleeve valves 202 and 204 are in their respective open positions as shown in FIG. 3E. The passageway 102 is constructed relative to connector means 196 in a fashion very similar to the hydraulic passage 100, so that similar ports in the sleeve valves 202 and 204 communicate with the passage 102 when the sleeve valves are in their open positions.

The following description of the interconnecting means is best understood if one first visualizes the orientation of the components prior to insertion of stinger mandrel 160 into stinger receiving tube 192. The stinger mandrel 160 is located above stinger receiving tube 192. The first sleeve valve 202 is connected to stinger mandrel 160 and is in a downwardmost position relative to stinger mandrel 160 closing the first hydraulic port 198 therein. The second sleeve valve 204 is located within stinger receiving tube 192 and is in an upwardmost position relative thereto closing the second hydraulic port 200 therein.

The interconnecting means includes first engagement means 210 on first sleeve valve 202 for engaging second sleeve valve 204 on an upward facing surface 212 thereof and holding first sleeve valve 202 relative to second sleeve valve 204 as stinger mandrel 160 is moved downward relative to first and second sleeve valves 202 and 204 to open said first sleeve valve 202.

The interconnecting means further includes a coil compression spring biasing means 214 for biasing second sleeve valve 204 in an upward direction toward its said closed position.

The interconnecting means also includes a second engagement means 216, on stinger mandrel 160, for engaging a second upward facing surface 218 of second sliding sleeve valve 204, and for moving said second sliding sleeve valve 204 downward relative to stinger receiving tube 192 to the said open position of second sleeve valve 204 when the stinger mandrel 160 is inserted in stinger receiving tube 192.

First sleeve valve 202 includes a spring collet finger 220 having a radially outwardly extending shoulder 222 which includes the first engagement means 210 which is a tapered surface on the shoulder 222. The spring collet finger 220 is resiliently yieldable in a radially inward direction so that upon exertion of a predetermined force on first sleeve valve 202 in a downward direction the shoulder 222 of spring collet finger 220 snaps past a corresponding shoulder 224 which projects radially inward from second sleeve valve 204. The corresponding shoulder 224 includes the upward facing tapered surface 212 which defines an upper portion of shoulder 224.

The corresponding shoulder 224 of second sleeve valve 204 is located on a radially outward resilient spring collet finger 226 of second sleeve valve 204.

It will be understood by those skilled in the art that the first sliding sleeve valve 204 includes a plurality of spring collet fingers such as spring collet finger 220 which are spaced radially about the upper end of first sleeve valve 202. Similarly, second sleeve valve 204 includes a plurality of radially spaced separate spring collet fingers all of which have a lengthwise cross section like that of spring collet finger 226 shown on the left side of FIG. 3D.

The radially inward resilient spring collet finger 220 of first sleeve valve 202 includes a second tapered surface means 228 on shoulder 222 thereof for engaging a downward facing surface 230 of corresponding shoulder 224 of second sleeve valve 204 as stinger mandrel 160 is withdrawn in an upward direction from stinger mandrel receiving tube 192, and for holding first sleeve valve 202 as stinger mandrel 160 is moved upward relative to stinger mandrel receiving tube 192 so that first sleeve valve 202 is moved to its said closed position.

As just described, when first sleeve valve 202 is in its closed position it is moved downward from the position shown in FIGS. 3D and 3E relative to stinger mandrel 160, so that first valve port 206 is moved out of communication with first hydraulic port 198.

First sliding sleeve valve 202 also includes a plurality of downward extending collet fingers such as collet finger 232 which include a downward facing surface 234 for resilient engagement with a radially outward extending shoulder 236 of stinger mandrel 160. The downward facing surface 234 of collet finger 236 provides a releasable retaining means 234 for releasably retaining first sliding sleeve valve 202 in its said open position until second sleeve valve 204 is moved upward to its said closed position and second tapered surface means 228 of radially inward resilient collet spring finger 220 of first sleeve valve 202 is engaged with the corresponding shoulder 224 of second sleeve valve 204 as the stinger mandrel 160 is withdrawn from stinger mandrel receiving tube 192.

As previously mentioned a coil spring biasing member 214 is provided for urging second sleeve valve 204 upward relative to stinger mandrel receiving tube 192. When the stinger mandrel 160 is withdrawn from the stinger mandrel receiving tube 192, the coil spring 214 moves second sliding sleeve valve 204 upward to its closed position.

Upward travel of second sliding sleeve valve 204 is limited by engagement of an upper end 238 thereof with a downward facing surface 240 of stinger mandrel receiving tube 192.

Until upper end 238 engages downward facing surface 240 there is no movement of stinger mandrel 160 relative to either of first and second sleeve valves 202 and 204 as stinger mandrel 160 is withdrawn from stinger receiving tube 192.

However, once upper end 238 engages surface 240, the upward facing surface 228 of shoulder 222 of collet fingers 220 of first sleeve valve 202 engages the downward facing surface 230 of inward extending shoulder 224 of collet finger 226 of second sleeve valve 204. This engagement of surfaces 228 and 230 then holds first sleeve valve 202 relative to stinger probe 160 and the lower ends of downward extending collet fingers such as finger 232 of first sleeve valve 202 snap over the radially outward extending shoulder 226 of stinger mandrel 160 thereby moving stinger mandrel 160 upward relative to first sleeve valve 202 to the closed position of first sleeve valve 202. The use of sliding sleeve valves, as opposed for example, to spring loaded ball valves, as have often been used in the prior art, provides a means for disconnecting the passage portions in the stinger mandrel 160 from the passage portions in the stinger receiving tube 192 while preventing entry of any contaminating fluid into said passage portions during the connecting and disconnecting thereof, and provides a pressure balanced sealing means across the fluid passages so that hydraulic forces cannot actuate these valves prematurely.

Also it is noted that the closure of second sliding sleeve valve 204 hydraulically locks the ball valves 120 and 122 in whatever position they are in at the time.

The latch and hydraulic connector section 76 includes a latch means 242 shown at the lower portion of FIG. 3C and upper portion of 3D. Latch means 242 provides a means for releasably connecting stinger mandrel 160 and stinger receiving tube 192 when stinger mandrel 160 is inserted into stinger receiving tube 192, so that latch means 242 must be released before stinger mandrel 160 can be withdrawn from stinger mandrel receiving tube 192.

Latch means 176 includes a latching shoulder 244 defined on stinger mandrel 160. A plurality of radially inward biased spring collet fingers 246 extend upward from stinger receiving tube 192 and include a latching dog means 248 on the upper end of each collet finger 246 for engaging latching shoulder 244 to connect stinger mandrel 160 to stinger receiving tube 192.

The upward extending spring collet fingers 246 are attached to a threaded collar 250 which is threadedly attached to the remainder of stinger receiving tube 192 at threaded connection 252.

A hydraulically powered annular wedge 254 is disposed about stinger mandrel 160 for engaging a tapered surface 256 of latching dog means 248 and forcing latching dog means 248 to move radially outward out of engagement with latching shoulder 244.

An annular piston 258 is attached to an outer surface of stinger mandrel 160. The annular wedge means 254 is carried on a cylindrical sliding cylinder sleeve 260. Seal means 262 seals between piston 258 and an inner surface of sliding cylinder 260. Piston 258 and sleeve 260 comprise the hydraulic cylinder 114 shown schematically in FIG. 2.

Hydraulic fluid under pressure is directed from second solenoid valve 94 to either an upper end 264 of piston 258 or a lower end 266 of piston 258.

The fluid is conducted from second solenoid valve 94 to the upper end 264 of piston 258 by a passage 268 shown schematically in FIG. 2 and shown in more detail in FIGS. 3C and 3D. Fluid is conducted from second solenoid valve 94 to the bottom end 266 of piston 258 by a passage 269.

In the center portion of FIG. 3C, it is seen that the stinger mandrel 160 includes a first portion 270 and a second portion 272 connected together at threaded connection 274.

At an upper end 276 of second portion 272 of stinger mandrel 160 the schematic representation of passages 268 and 269 would appear to show a lack of communication between those portions of passageways 268 and 269 located within first portion 270 with those portions of passageways 268 and 269 located within second portion 272 of stinger mandrel 160.

Actually, for example, the passageway 268 is continuous through first and second portions 270 and 272 of stinger mandrel 160. The communication between those portions of passage 268 is provided by a longitudinal passageway located in the radially outer portion of first portion 270 of stinger mandrel 160 at a radially outward location located a distance outward from the central axis of stinger mandrel 160 equal to the outwardly distanced location of those parts 276 and 278 of passageways 100 and 102 designated in the middle of FIG. 3C. The upper and lower portions of passageway 268 are communicated with the radially outer passage located behind the portion 278 of passage 102 by radially directed passageways (not shown).

Again, it will be understood by those skilled in the art that that layout of the passageways shown in FIGS. 3A-3I is schematic only, due to the complexity and difficulty of showing those passageways completely in the exact manner in which they are actually constructed. There are, of course, numerous ways one could form the passageways in the various parts of the subsea test tree 44.

As previously mentioned, the closure valve section 74 includes an upper ball valve member 120 and a lower ball valve member 122. The upper ball valve member 120 is powered by a piston 276 of first hydraulic cylinder 88 and the second ball valve member 122 is powered by a piston 278 of second hydraulic cylinder 90.

The details of the construction of the closure valve section 74 of subsea test tree 44 are very similar to the details of construction of the similar components of the subsea test tree disclosed in U.S. Pat. No. 4,116,272 to Barrington, in FIGS. 3D-3E thereof, and those details are incorporated herein by reference. As previously mentioned, the subsea test tree 44 is shown only schematically in FIGS. 3A-3I of the present application, and therefore the structure illustrated may vary in small details from that shown in U.S. Pat. No. 4,116,272, but the overall principles of operation of the closure valve sections are essentially the same.

Figure 3F:
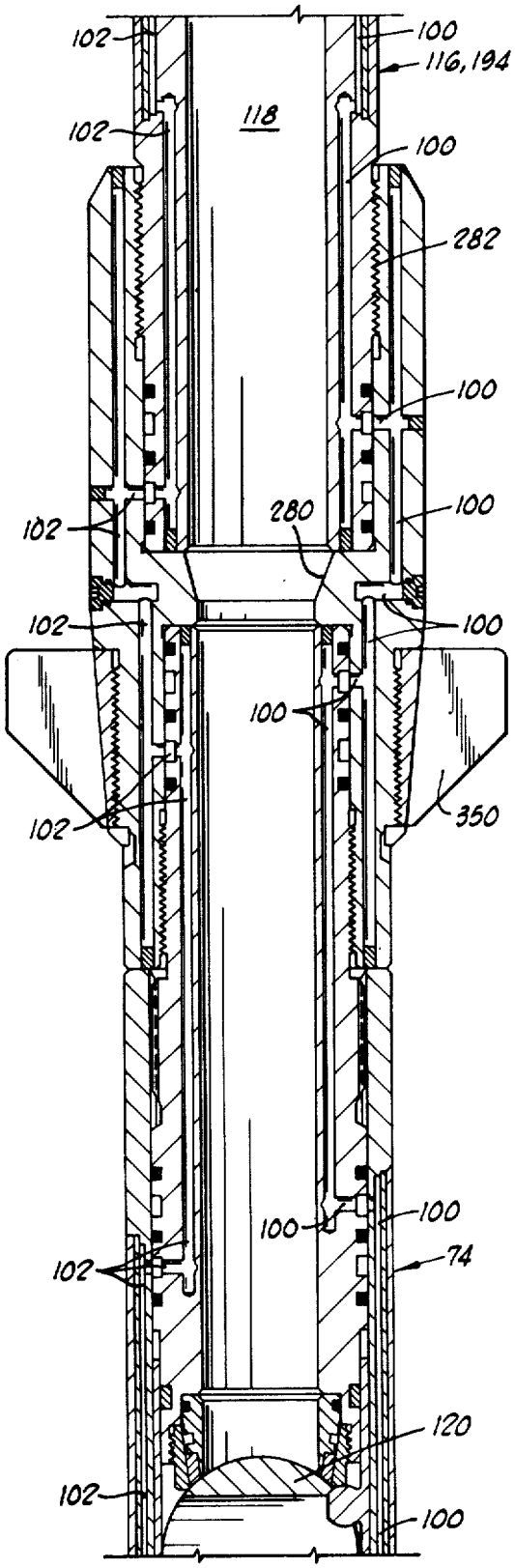
Figure 3G:
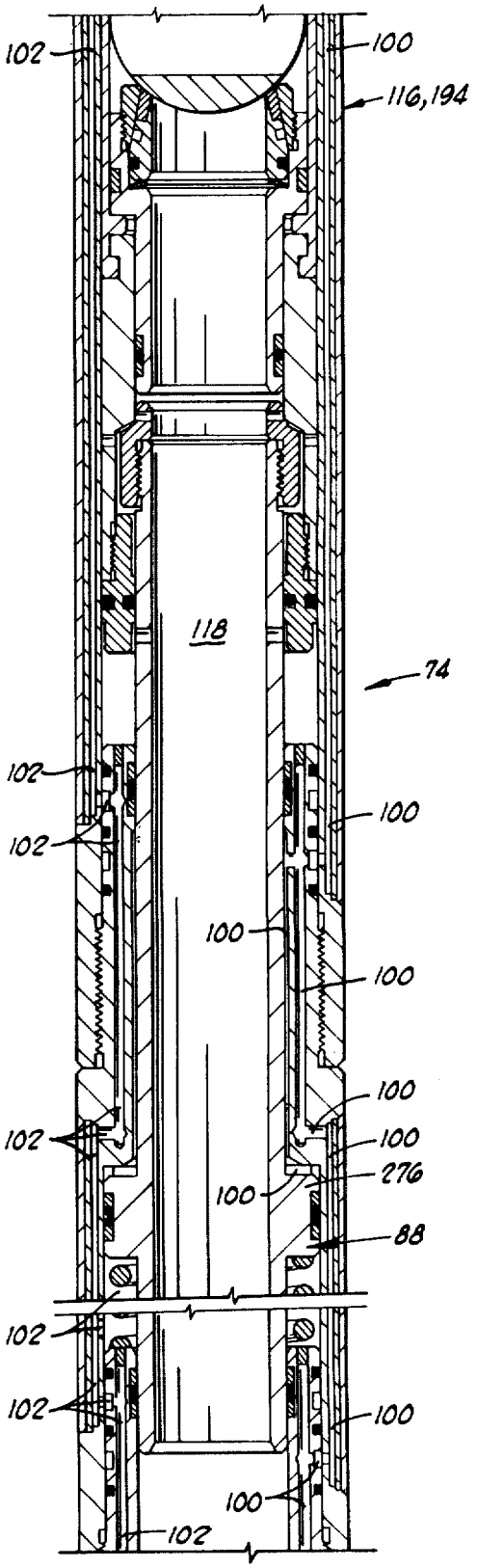
Figure 3H:
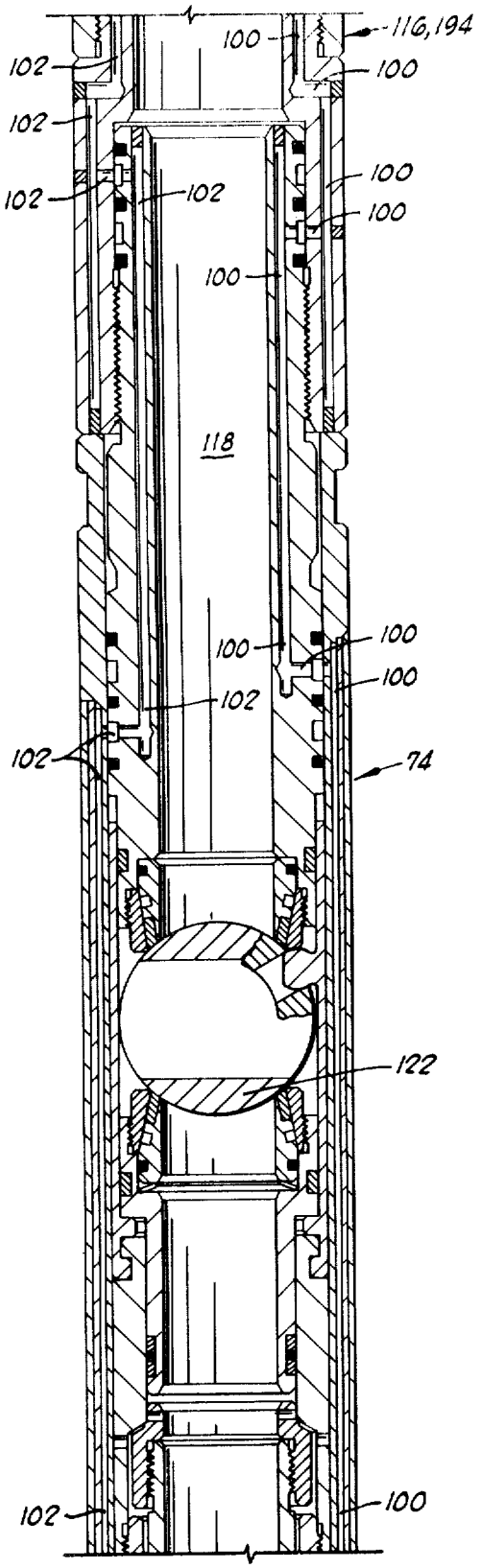
Figure 3I:
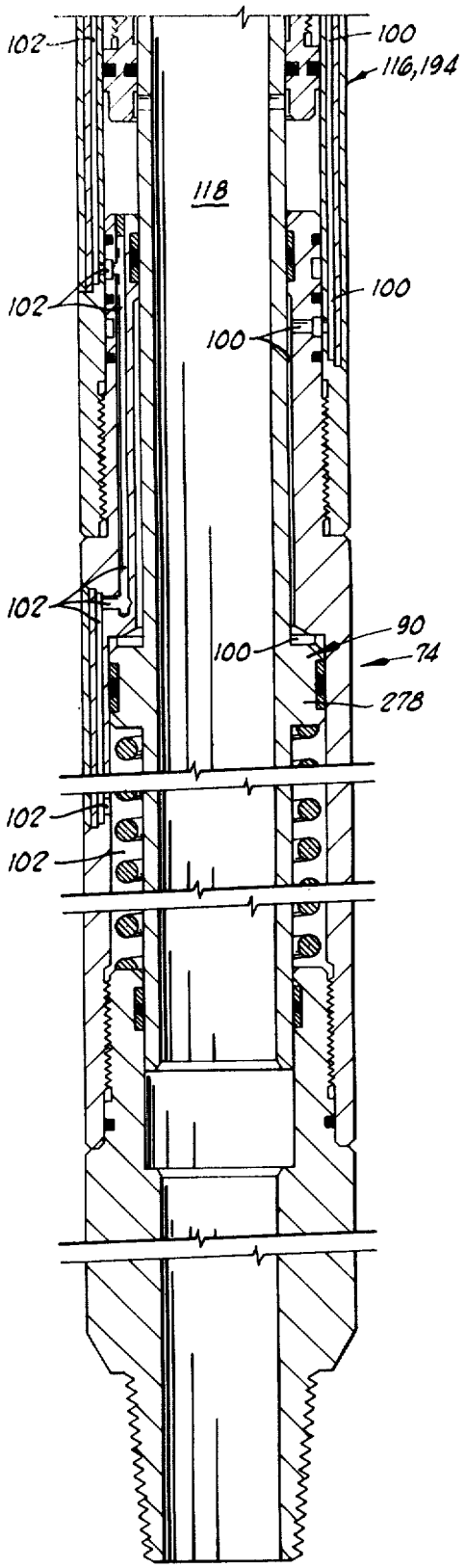

One particular feature of closure valve section 74 which should be mentioned is that the internal diameter of bore 118 decreases at the tapered inner surface 280 shown in FIG. 3F. This is because of limitations on the outside diameter of the subsea test tree below fluted hanger 350 due to the size of the casing 16 for which the specific embodiment illustrated was designed.

For a casing 16 of larger diameter the dimensions could be increased so that the reduced inner diameter is not necessary. Those portions of subsea test tree 44 above threaded connection 282 shown in FIG. 3F are of a standard design and do not change regardless of the size of casing 16. Those portions of subsea test tree 44 below connection 282 are modified for different sizes of casing 16.

Referring now to FIG. 4, an alternative embodiment of the subsea test tree of the present invention is shown and generally designated by the numeral 300. The subsea test tree 300 differs from the subsea test tree 44 of FIG. 2 primarily in that the hydraulic fluid supply system has been modified to replace the floating piston 84 and chambers 80 and 82 with a hydraulic pump 302 driven by an electric motor 304 receiving power from a battery means 306 and controlled by signals from signal receiving means 101 and 101A through electrical connecting means 308 and 310, respectively.

The pump 302, motor 304, and battery 306 are located within the same area of the subsea test tree 44 occupied by the first and second zones 80 and 82 and the floating piston 84, in the embodiment of FIG. 2.

Pump 302 is preferably an annular shaped pump having a plurality of longitudinally reciprocating pistons.

Referring now to FIGS. 5–8, apparatus is there illustrated for providing acoustic coupling means between adjacent pipe segments of the well test string 34. For example, as shown in FIG. 5, the well test string 34 is assembled from a plurality of pipe segments such as first segment 320 and second segment 322. The pipe segments 320 and 322 are conventional pin and box threaded drill pipe.

A lower end of pipe segment 320 is shown which has a threaded pin portion 324 disposed thereon and which has a downward facing shoulder 326.

An upper end of second pipe segment 322 is shown which has a box portion 328 and an upward facing shoulder 330 opposed to shoulder 326.

An acoustic coupler or coupling means 332 is connected between first and second pipe segments 320 and 322 for transmitting the acoustic signal previously described from the first pipe segment 320 through the acoustic coupling means 332 to the second pipe segment 322.

Similar acoustic coupling means are connected between all the adjacent pipe segments of well test string 34 between the acoustic transmittor 70 and the acoustic receiver 101.

The reason the acoustic coupling means 332 is desirable is that the threaded connections between pipe segments are typically greasy and dirty, and this thin layer of grease greatly dampens the acoustic signal as it is transmitted therethrough. The large plurality of connections between pipe segments within a well test string 34 can therefore cause significant and serious damping of the acoustic signal. By providing a transmission path for the acoustic signal through the acoustic coupling means 322 which has a relatively clean engagement with the shoulder 326 and 330 of pipe segments 320 and 322, respectively, this damping problem is greatly improved.

Referring now to FIG. 6 a plan view is shown of one of the acoustic coupling means 332 which may be generally described as an annular metal washer. The annular ring or washer has a cross section such as shown in FIG. 7. As is shown in FIG. 7, the acoustic coupling means 332 has a flat plate cross section being substantially wider across a dimension 334 in a radial direction than it is thick as shown by dimension 336 in a direction parallel to the central axis 338 of the washer 332.

The acoustic coupling means 332 is initially formed with a plurality of deformed portions such as 340 and 342 which are offset in a direction parallel to the axis 338 from a final planar configuration such as shown in FIG. 5 of the ring 332. The deformed portions 340 and 342 are adapted to be compressed between the shoulders 326 and 330 to conform to said final planar configuration.

Preferably the deformed portions 340 and 342 and a plurality of additional deformed portions are arranged on the washer 332 so as to form a continuous annular pattern of regular fixed undulations. In other words, the washer 332 looks as though it has a series of standing waves therein.

This initial deformation provides a resilient feature to the washer 332 which causes it to more tightly engage the shoulders 326 and 330 of the pipe segments 320 and 322.

In FIG. 8, an alternative embodiment of an acoustic coupling means is shown which includes an acoustic coupling means 340, which is an annular ring having an initially circular cross section, disposed in an annular groove 342 in the end portion 322 of first pipe segment 320. The annular ring 340 is shown in a plan view in FIG. 9 and has a gap 344 located between two ends 346 and 348 thereof.

As is shown in FIG. 8, the annular ring 340 also engages the second pipe segment 322.

The general manner of operation of the subsea test tree 44 of the present invention is as follows. First the subsea test tree 44 is connected to a pipe string to make up a well test string 34 as previously illustrated and described with reference to FIG. 1. Then the pipe string and the subsea test tree 44 are lowered from the floating structure 10 to the subsea well defined by the well casing 14. The subsea test tree 44 is then located within the blowout preventors of the well head installation 22 and its position therein is generally defined by the landing of a fluted hanger 350 (see FIG. 3F) against an upset internal diameter portion of the well head installation 22 as is well known to those skilled in the art. The connection of the subsea test tree to the blowout preventor is described in much greater detail in U.S. Pat. No. 4,116,272.

Then an acoustic command signal is transmitted from the surface by means of the surface control 66 and the transmittor 70 which induces an acoustic signal in the well test string 34. The acoustic command signal travels down the well test string 34 and is received by the acoustic command signal receiving means 101 at the subsea test tree 44.

Then the closure valve section 74 is actuated in response to said acoustic command signal to move the spherical ball valve members 120 and 122 to one of their respective open and closed positions.

When it is desired to test the subsurface formation 18, the closure valves are opened so that fluid can flow from the formation 18 up through the well test string 34 to the floating structure 10. When it is desired to stop the testing, the closure valve section 74 is closed to close the fluid passageway 118 through the subsea test tree 44.

When rough weather makes it desirable to quickly disconnect the well test string 34 from the well head installation 22, it is desirable to be able to close the valves of the closure valve section 74 and disconnect the upper portion of the well test string above well head installation 22 from the lower portion of the well test string connected to and located below well head installation 22. This is desirably done while maintaining the ball valves in a closed position within the closure valve section 74.

This is accomplished with the present invention by transmitting a second acoustic command signal down the well test string 34 to the portion 101A of the acoustic signal receiving means 101 of the subsea test tree 44. Then the releasable latching means 242 is operated to release the stinger mandrel 160 from the stinger receiving tube 192 in response to said second acoustic command signal.

The upper portion of the well test string 34 including the upper body portion 90 of subsea test tree 44 is then moved out of engagement with the lower body portion 194 of subsea test tree 44 and the portion of the well test string including the upper body portion 190 may then be retrieved to the floating structure 10 while the lower body portion 194 and the portion of the well test string attached thereto including the closure valve section 74 remains connected to the blowout preventor stack of the well head installation 22 located upon the ocean floor.

This allows the well to be shut in and the floating structure 10 to be disconnected therefrom during rough weather so as to prevent the possibility of breaking the well string 34 and causing a well blowout during the rough weather.

Thus, it is seen that the Hydraulic Fluid Supply Apparatus for A Downhole Tool of the present invention readily achieves the ends and advantages mentioned as well as those inherent therein. While presently preferred embodiments of the invention have been specifically described for the purpose of this disclosure, numerous changes in the arrangement and construction of the parts can be made by those skilled in the art, which changes are encompassed within the spirit of this invention as defined by the appended claims.

What is claimed is:

1. A hydraulic fluid supply apparatus for a downhole tool, comprising:

a first zone adapted to be filled with hydraulic fluid;

a second zone adapted to be filled with a pressurized second fluid, said second zone being completely defined within a container means adapted to be placed downhole;

floating piston means, separating said first and second zones, for transmitting pressure from fluid in one of said zones to fluid in the other of said zones; and control valve means, connected between said first zone and a hydraulically powered component of said downhole tool, for directing hydraulic fluid under pressure from said first zone to said hydraulically powered component of said downhole tool.

2. The apparatus of claim 1, further comprising:

an outer tubular member; and an inner tubular member disposed within said outer tubular member;

wherein said floating piston means is annular in shape and is disposed between said outer and inner tubular members;

wherein said first zone is partially defined by said outer and inner tubular members and a first side of said floating piston means; and wherein said second zone is partially defined by said outer and inner tubular members and a second side of said floating piston means.

3. The apparatus of claim 2, wherein:

said floating piston means includes radially outer and inner seals sealingly engaging said outer and inner tubular members, respectively.

4. The apparatus of claim 1, further comprising:

a dump chamber for receiving hydraulic fluid from a low pressure side of said hydraulically powered component of said downhole tool.

5. The apparatus of claim 4, wherein:

said control valve means is further characterized as including a means for directing hydraulic fluid from said low pressure side of said hydraulically powered component to said dump chamber.

6. The apparatus of claim 1 in combination with said downhole tool, wherein:

said downhole tool includes a subsea test tree; and said hydraulically powered component of said downhole tool includes a hydraulically powered closure valve means for selectively opening and closing a passageway of said subsea test tree.

7. The combination of claim 6, wherein said subsea test tree comprises:

an upper body portion in which said hydraulic fluid supply apparatus is disposed;

a lower body portion in which said closure valve means is disposed; and releasable latching means for connecting said upper and lower body portions so that said hydraulic fluid supply apparatus may be released and retrieved to a surface of a body of water in which said subsea test tree is submerged, while said lower body portion and said closure valve means remain attached to a well head located on a floor of said body of water.

8. A hydraulic fluid supply apparatus, comprising:

an upper adapter;

a lower adapter;

an outer cylindrical tubular casing means having an upper end attached to said upper adapter and a lower end attached to said lower adapter;

an inner cylindrical mandrel means concentrically disposed within said outer cylindrical tubular casing means and having upper and lower ends connected to said upper and lower adapters, respectively, said upper and lower adapters and an inner and an outer cylindrical surface of said casing and said mandrel, respectively, defining an annular cavity therebetween;

a fixed annular divider means, connected between said inner and outer cylindrical surfaces of said casing and mandrel, respectively, and fixed to each of said casing and mandrel, for separating said annular cavity into first and second annular cavity portions; and a movable annular divider means, sealingly engaging said inner and outer cylindrical surfaces of said casing and mandrel, respectively, for separating said first annular cavity portion into first and second annular zones and for transmitting pressure from fluid in one of said zones to fluid in the other of said zones.

9. The apparatus of claim 8, wherein:

said first annular zone is adapted to be filled with hydraulic fluid;

said second annular zone is adapted to be filled with a pressurized second fluid; and said second annular cavity portion is further characterized as being a dump chamber for receiving low pressure hydraulic fluid.

10. The apparatus of claim 9, further comprising:

control valve means for directing hydraulic fluid under pressure from said first zone to a hydraulically powered component of a downhole tool, and for directing hydraulic fluid from a low pressure side of said hydraulically powered component to said dump chamber.

11. The apparatus of claim 10, wherein:

said control valve means is located in a control valve housing below said lower adapter;

said lower adapter has a supply passage means disposed therein for conducting hydraulic fluid from said first zone to said control valve means; and said lower adapter, outer tubular casing means and fixed annular divider have a return passage means disposed therein for conducting hydraulic fluid from said control valve means to said dump chamber.

12. The apparatus of claim 8, wherein:

said casing means includes an upper casing portion having an upper end attached to said upper adapter and having a lower end attached to said fixed annular divider means, and includes a lower casing portion having an upper end attached to said fixed annular divider means and a lower end attached to said lower adapter.

13. The apparatus of claim 12, wherein:

said inner mandrel means includes an upper mandrel portion having an upper end attached to said upper adapter and having a lower end attached to said fixed annular divider means, and includes a lower mandrel portion having an upper end attached to said fixed annular divider means and a lower end attached to said lower adapter.

14. An apparatus of claim 8, wherein:

said inner mandrel means includes an upper mandrel portion having an upper end attached to said upper adapter and having a lower end attached to said fixed annular divider means, and includes a lower mandrel portion having an upper end attached to said fixed annular divider means and a lower end attached to said lower adapter.

15. A method of supplying hydraulic fluid under pressure to a downhole tool, said method comprising the steps of:

connecting to said downhole tool a hydraulic fluid supply apparatus having first and second zones, floating, piston means separating said first and second zones, and control valve means, connected between said first zone and a hydraulically powered component of said downhole tool, for directing hydraulic fluid under pressure from said first zone to said hydraulically powered component;

filling said first zone with hydraulic fluid;

filling said second zone with a pressurized second fluid;

sealing and isolating said second fluid in said second zone thereby providing a self-contained fluid pressure source;

transmitting pressure from said second fluid in said second zone to said hydraulic fluid in said first zone by means of said floating piston means; and moving said control valve means to a first position and thereby directing hydraulic fluid under pressure to said hydraulically powered component.

16. The method of claim 15, wherein said fluid supply apparatus includes a dump chamber, and said method further comprising:

directing hydraulic fluid from a low pressure side of said hydraulically powered component to said dump chamber by means of said control valve means.

17. The method of claim 15, wherein said downhole tool is a subsea test tree and said hydraulically powered component includes a closure valve means disposed in said subsea test tree, and wherein said method further comprises:

moving said closure valve means between an open and a closed position in response to said pressure of said hydraulic fluid directed to said hydraulically powered component.

* * * * *